US008602523B2

(12) United States Patent
Grabowski et al.

(10) Patent No.: US 8,602,523 B2
(45) Date of Patent: Dec. 10, 2013

(54) FLUORINATED POLY(AMIDE-IMIDE) COPOLYMER PRINTHEAD COATINGS

(75) Inventors: Edward F Grabowski, Webster, NY (US); Yuhua Tong, Hockessin, DE (US)

(73) Assignee: Xerox Corporation, Norwalk, CT (US)

( * ) Notice: Subject to any disclaimer, the term of this patent is extended or adjusted under 35 U.S.C. 154(b) by 49 days.

(21) Appl. No.: 13/294,450

(22) Filed: Nov. 11, 2011

(65) Prior Publication Data

US 2013/0120498 A1 May 16, 2013

(51) Int. Cl.
*B41J 2/14* (2006.01)

(52) U.S. Cl.
USPC ..... 347/37; 528/59; 528/76; 528/83; 528/367; 528/401

(58) Field of Classification Search
USPC ..... 528/59, 83, 367, 401
See application file for complete search history.

(56) References Cited

U.S. PATENT DOCUMENTS

| | | | | |
|---|---|---|---|---|
| 3,810,874 | A * | 5/1974 | Mitsch et al. | 528/70 |
| 5,446,205 | A | 8/1995 | Marchionni et al. | |
| 5,508,380 | A * | 4/1996 | Turri et al. | 528/401 |
| 6,737,109 | B2 * | 5/2004 | Stanton et al. | 427/235 |
| 6,924,036 | B2 | 8/2005 | Polastri et al. | |
| 7,329,784 | B2 | 2/2008 | Marchionni et al. | |
| 7,862,160 | B2 | 1/2011 | Andrews et al. | |
| 7,862,678 | B2 | 1/2011 | Andrews et al. | |
| 7,934,815 | B2 | 5/2011 | Brick et al. | |
| 2004/0024153 | A1 | 2/2004 | Di Meo et al. | |
| 2010/0149262 | A1 | 6/2010 | Lin et al. | |
| 2011/0157276 | A1 | 6/2011 | Zhao et al. | |
| 2011/0157277 | A1 | 6/2011 | Zhao et al. | |
| 2011/0157278 | A1 | 6/2011 | Gulvin et al. | |
| 2011/0228005 | A1 | 9/2011 | Gulvin et al. | |

OTHER PUBLICATIONS

Tsay et al., "Synthesis and Properties of Fluorinated Polyamideimides with High Solubility", Journal of Applied Polymer Science, 2005, vol. 95, 321-327.*

"Integer", Merriam-Webster, http://www.merriam-webster.com/dictionary/integer, Oct. 10, 2013, 2 pages.*

"Study of Wetting and Adhesion Interactions between Water and Various Polymer and Superhydrophobic Surfaces," Benedict Samuel, Hong Zhao, and Kock-Yee Law, J. Phys. Chem. C, 2011, 115, 14582-14861.

* cited by examiner

*Primary Examiner* — Nicole M Buie-Hatcher
(74) *Attorney, Agent, or Firm* — Judith L. Byorick

(57) ABSTRACT

Disclosed is an ink jet printhead comprising a plurality of channels, wherein the channels are capable of being filled with ink from an ink supply and wherein the channels terminate in nozzles on one surface of the printhead, the surface being coated with a coating composition comprising a fluorinated poly(amide-imide) copolymer.

19 Claims, 2 Drawing Sheets

FLUORINATED POLY(AMIDE-IMIDE) COPOLYMER PRINTHEAD COATINGS

BACKGROUND

Disclosed herein are ink jet printheads having fluorinated poly(amide-imide) copolymer front face coatings.

Ink jet systems include one or more printheads having a plurality of jets from which drops of fluid are ejected towards a recording medium. The jets of a printhead receive ink from an ink supply chamber or manifold in the printhead which, in turn, receives ink from a source, such as an ink reservoir or an ink cartridge. Each jet includes a channel having one end in fluid communication with the ink supply manifold. The other end of the ink channel has an orifice or nozzle for ejecting drops of ink. The nozzles of the jets can be formed in an aperture or nozzle plate having openings corresponding to the nozzles of the jets. During operation, drop ejecting signals activate actuators in the jets to expel drops of fluid from the jet nozzles onto the recording medium. By selectively activating the actuators of the jets to eject drops as the recording medium and/or printhead assembly are moved relative to one another, the deposited drops can be precisely patterned to form particular text and graphic images on the recording medium. An example of a full width array printhead is described in U.S. Pat. No. 7,591,535, the disclosure of which is totally incorporated herein by reference. An example of an ultra-violet curable gel ink which can be jetted in such a printhead is described in U.S. Pat. No. 7,714,040, the disclosure of which is totally incorporated herein by reference. An example of a phase change ink which can be jetted in such a printhead is the Xerox Color Qube™ cyan solid ink available from Xerox Corporation. U.S. Pat. No. 5,867,189, the disclosure of which is totally incorporated herein by reference, describes an ink jet printhead including an ink ejecting component which incorporates an electropolished ink-contacting or orifice surface on the outlet side of the printhead. Additional examples of ink jet printheads are disclosed in U.S. Pat. Nos. 7,934,815, 7,862,678, and 7,862,160, the disclosures of each of which are totally incorporated herein by reference. Thermal ink jet systems, in which the expansion of a bubble forces a droplet of ink out of the nozzle, are also known, as disclosed in, for example, U.S. Pat. Nos. 4,601,777, 4,251,824, 4,410,899, 4,412,224, and 4,532,530, the disclosures of each of which are totally incorporated herein by reference. Also known are acoustic ink jet printing systems, as disclosed in, for example, U.S. Pat. Nos. 4,308,547, 4,697,195, 5,028,937, 5,041,849, 4,751,529, 4,751,530, 4,751,534, 4,801,953, and 4,797,693, the disclosures of each of which are totally incorporated herein by reference. Other known droplet ejectors include those of the type disclosed in, for example, U.S. Pat. No. 6,127,198, the disclosure of which is totally incorporated herein by reference.

One difficulty faced by ink jet systems is wetting, drooling, or flooding of inks onto the printhead front face. Such contamination of the printhead front face can cause or contribute to blocking of the ink jet nozzles and channels, which alone or in combination with the wetted, contaminated front face, can cause or contribute to non-firing or missing drops, undersized or otherwise wrong-sized drops, satellites, or misdirected drops on the recording medium, and thus result in degraded print quality.

Current printhead front face coatings are often sputtered polytetrafluoroethylene coatings. When the printhead is tilted, some inks do not readily slide on the printhead front face surface. Rather, these inks flow along the printhead front face and leave an ink film or residue on the printhead which can interfere with jetting. For this reason, the front faces of UV and solid ink printheads are prone contamination by UV and solid inks.

In some cases, the contaminated printhead can be refreshed or cleaned with a maintenance unit. Such an approach, however, introduces system complexity, hardware cost, and sometimes reliability issues. Contamination of the printhead can also be somewhat minimized by adopting purging procedures. These procedures, however, can consume time and use excessive amounts of ink.

In the case of inks such as phase change and UV curable gel inks, contamination of a printhead front face can also be minimized by providing an oleophobic low adhesion front face coating that does not wet significantly with ink ejected from nozzle openings of the printhead. When heated to temperatures typically encountered during printhead fabrication processes, however, the surface property characteristics of many known oleophobic low adhesion coatings degrade to the point that they cannot be relied upon to minimize contamination of the printhead front face.

A need thus remains for an improved printhead front face design that reduces or eliminates wetting, drooling, flooding, or contamination of ink, including UV or solid ink, over the printhead front face. In addition, a need remains for an improved printhead front face design that is ink phobic and robust to withstand maintenance procedures such as wiping of the printhead front face. Further, a need remains for an improved printhead that is easily cleaned or in some cases that is self-cleaning, thereby reducing or eliminating hardware complexity, such as the need for a maintenance unit, reducing run cost and improving system reliability. Additionally, a need remains for materials for coating printhead front faces that, while enabling excellent cleaning and, in many cases, self-cleaning properties, also is sufficiently robust to survive both the temperature and pressure conditions encountered during printhead fabrication and the temperature conditions encountered during printer operation without degradation. There is also a need for printhead front face coatings that exhibit improved anti-scratch properties. In addition, there is a need for printhead front face coatings that exhibit improved chemical resistance to varied chemical environments.

SUMMARY

Disclosed herein is an ink jet printhead comprising a plurality of channels, wherein the channels are capable of being filled with ink from an ink supply and wherein the channels terminate in nozzles on one surface of the printhead, the surface being coated with a coating composition comprising a fluorinated poly(amide-imide) copolymer.

DETAILED DESCRIPTION

Figure 1:
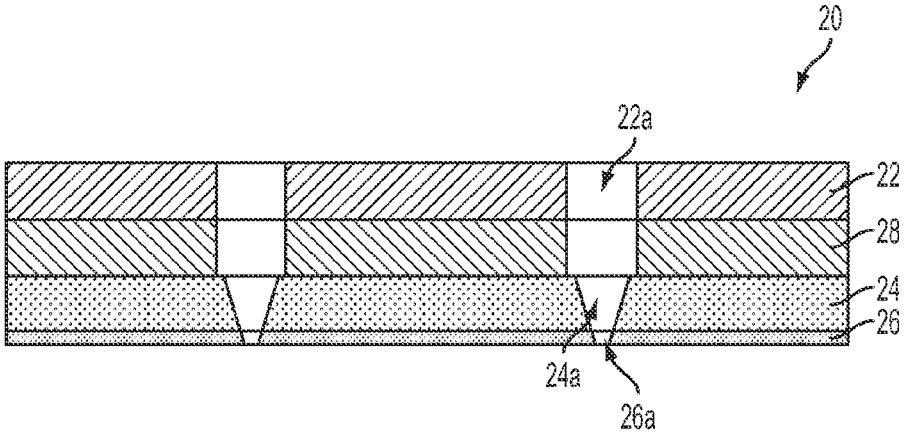
FIG. 1 is a sectional view of an ink jet printhead according to some embodiments disclosed herein.

Disclosed herein is a hydrophobic and oleophobic low adhesion surface coating for an ink jet printhead front face. When the coating is disposed on an ink jet printhead front face surface, jetted drops of inks, including ultra-violet (UV) gel ink (also referred to herein as "UV ink") and solid ink, exhibit low adhesion towards the surface coating. The adhesion of an ink drop toward a surface can be determined by measuring the sliding angle of the ink drop (i.e., the angle at which a surface is inclined relative to a horizontal position when the ink drop begins to slide over the surface without leaving residue or stain behind). The lower the sliding angle, the lower the adhesion between the ink drop and the surface. As used herein, the term "low adhesion" means a low sliding angle of in one embodiment at least about 1°, and in one embodiment no more than about 30°, in another embodiment no more than about 25°, and in yet another embodiment no more than about 20°, although the sliding angles can be outside of these ranges.

The term "hydrophobic" as used herein means that water forms a contact angle with the surface of the coating of at least about 90°, and in many embodiments greater angles of 100° or more. The term "oleophobic" as used herein means that hexadecane forms a contact angle with the surface of the coating of at least about 60°, and in many embodiments greater angles of 80° or more.

The coatings disclosed herein comprise a fluorinated poly (amide-imide) copolymer. More specifically, the polymer is a copolymer of a poly(amide-imide) and a fluorinated ether. Examples of suitable poly(amide-imide)/fluorinated ether copolymers include block, alternating, and/or random copolymers such as those of the formulae

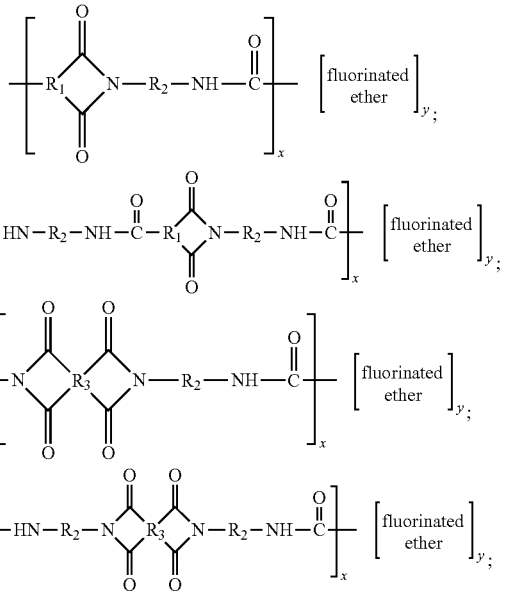

and mixtures thereof, wherein: (i) $R_1$ is: (A) an arylene group, including substituted and unsubstituted arylene groups, wherein hetero atoms, such as oxygen, nitrogen, sulfur, silicon, phosphorus, boron, or the like either may or may not be present in the arylene group, in one embodiment with at least about 5 carbon atoms, and in another embodiment with at least about 6 carbon atoms, and in one embodiment with no more than about 36 carbon atoms, in another embodiment with no more than about 28 carbon atoms, and in yet another embodiment with no more than about 24 carbon atoms, although the number of carbon atoms can be outside of these ranges, such as phenyl or the like; (B) an arylalkylene group, including substituted and unsubstituted arylalkylene groups, wherein the alkyl portion of the arylalkylene can be linear, branched, saturated, unsaturated, and/or cyclic, and wherein hetero atoms, such as oxygen, nitrogen, sulfur, silicon, phosphorus, boron, or the like either may or may not be present in either or both of the alkyl portion and the aryl portion of the arylalkylene group, in one embodiment with at least about 6 carbon atoms, and in another embodiment with at least about 7 carbon atoms, and in one embodiment with no more than about 36 carbon atoms, in another embodiment with no more than about 28 carbon atoms, and in yet another embodiment with no more than about 24 carbon atoms, although the number of carbon atoms can be outside of these ranges, such as benzyl or the like; or (C) an alkylarylene group, including substituted and unsubstituted alkylarylene groups, wherein the alkyl portion of the alkylarylene can be linear, branched, saturated, unsaturated, and/or cyclic, and wherein hetero atoms, such as oxygen, nitrogen, sulfur, silicon, phosphorus, boron, or the like either may or may not be present in either or both of the alkyl portion and the aryl portion of the alkylarylene group, in one embodiment with at least about 6 carbon atoms, and in another embodiment with at least about 7 carbon atoms, and in one embodiment with no more than about 36 carbon atoms, in another embodiment with no more than about 28 carbon atoms, and in yet another embodiment with no more than about 24 carbon atoms, although the number of carbon atoms can be outside of these ranges, such as tolyl or the like;

(ii) $R_2$ is: (A) an alkylene group, including linear, branched, saturated, unsaturated, cyclic, substituted, and unsubstituted alkylene groups, wherein hetero atoms, such as oxygen, nitrogen, sulfur, silicon, phosphorus, boron, or the like either may or may not be present in the alkylene group, in one embodiment with at least about 2 carbon atoms, in another embodiment with at least about 4 carbon atoms, and in yet another embodiment with at least about 6 carbon atoms, and in one embodiment with no more than about 36 carbon atoms, in another embodiment with no more than about 28 carbon atoms, and in yet another embodiment with no more than about 24 carbon atoms, although the number of carbon atoms can be outside of these ranges; (B) an arylene group, including substituted and unsubstituted arylene groups, wherein hetero atoms, such as oxygen, nitrogen, sulfur, silicon, phosphorus, boron, or the like either may or may not be present in the arylene group, in one embodiment with at least about 5 carbon atoms, and in another embodiment with at least about 6 carbon atoms, and in one embodiment with no more than about 36 carbon atoms, in another embodiment with no more than about 28 carbon atoms, and in yet another embodiment with no more than about 24 carbon atoms, although the number of carbon atoms can be outside of these ranges, such as phenyl or the like; (C) an arylalkylene group, including substituted and unsubstituted arylalkylene groups, wherein the alkyl portion of the arylalkylene can be linear, branched, saturated, unsaturated, and/or cyclic, and wherein hetero atoms, such as oxygen, nitrogen, sulfur, silicon, phosphorus, boron, or the like either may or may not be present in either or both of the alkyl portion and the aryl portion of the arylalkylene group, in one embodiment with at least about 6 carbon atoms, and in another embodiment with at least about 7 carbon atoms, and in one embodiment with no more than about 36 carbon atoms, in another embodiment with no more than about 28 carbon atoms, and in yet another embodiment with no more than about 24 carbon atoms, although the number of carbon atoms can be outside of these ranges, such as benzylene or the like; or (D) an alkylarylene group, including substituted and unsubstituted alkylarylene groups, wherein the alkyl portion of the alkylarylene can be linear, branched, saturated, unsaturated, and/or cyclic, and wherein hetero atoms, such as oxygen, nitrogen, sulfur, silicon, phosphorus, boron, or the like either may or may not be present in either or both of the alkyl portion and the aryl portion of the alkylarylene group, in one embodiment with at least about 6 carbon atoms, and in another embodiment with at least about 7 carbon atoms, and in one embodiment with no more than about 36 carbon atoms, in another embodiment with no more than about 28 carbon atoms, and in yet another embodiment with no more than about 24 carbon atoms, although the number of carbon atoms can be outside of these ranges, such as tolylene or the like; and (iii) $R_3$ is: (A) an arylene group, including substituted and unsubstituted arylene groups, and wherein hetero atoms, such as oxygen, nitrogen, sulfur, silicon, phosphorus, boron, or the like either may or may not be present in the arylene group, in one embodiment with at least about 5 carbon atoms, and in another embodiment with at least about 6 carbon atoms, and in one embodiment with no more than about 36 carbon atoms, in another embodiment with no more than about 28 carbon atoms, and in yet another embodiment with no more than about 24 carbon atoms, although the number of carbon atoms can be outside of these ranges, such as phenyl or the like; (B) an arylalkylene group, including substituted and unsubstituted arylalkylene groups, wherein the alkyl portion of the arylalkylene can be linear, branched, saturated, unsaturated, and/or cyclic, and wherein hetero atoms, such as oxygen, nitrogen, sulfur, silicon, phosphorus, boron, or the like either may or may not be present in either or both of the alkyl portion and the aryl portion of the arylalkylene group, in one embodiment with at least about 6 carbon atoms, and in another embodiment with at least about 7 carbon atoms, and in one embodiment with no more than about 36 carbon atoms, in another embodiment with no more than about 28 carbon atoms, and in yet another embodiment with no more than about 24 carbon atoms, although the number of carbon atoms can be outside of these ranges, such as benzyl or the like; or (C) an alkylarylene group, including substituted and unsubstituted alkylarylene groups, wherein the alkyl portion of the alkylarylene can be linear, branched, saturated, unsaturated, and/or cyclic, and wherein hetero atoms, such as oxygen, nitrogen, sulfur, silicon, phosphorus, boron, or the like either may or may not be present in either or both of the alkyl portion and the aryl portion of the alkylarylene group, in one embodiment with at least about 6 carbon atoms, and in another embodiment with at least about 7 carbon atoms, and in one embodiment with no more than about 36 carbon atoms, in another embodiment with no more than about 28 carbon atoms, and in yet another embodiment with no more than about 24 carbon atoms, although the number of carbon atoms can be outside of these ranges, such as tolyl or the like;

(iv) "fluorinated ether" represents one or more partially fluorinated or fully fluorinated (perfluorinated) ether monomers, such as (but not limited to) block, random, and alternating copolymers having two, three, or more different fluorinated ether monomers, such as those of the formula $$\left[\left[O-R_4\right]_m\left[O-R_5\right]_n\right]_y$$

wherein:

$R_4$ is: (A) a partially fluorinated or fully fluorinated (perfluorinated) alkylene group, including linear, branched, saturated, unsaturated, cyclic, substituted, and unsubstituted alkylene groups, wherein hetero atoms, such as oxygen, nitrogen, sulfur, silicon, phosphorus, boron, or the like either may or may not be present in the alkylene group, in one embodiment with at least about 1 carbon atom, embodiment with no more than about 18 carbon atoms, in another embodiment with no more than about 12 carbon atoms, and in yet another embodiment with no more than about 6 carbon atoms, although the number of carbon atoms can be outside of these ranges, and wherein the degree of fluorination is in one embodiment at least about 5%, in another embodiment at least about 10%, and in yet another embodiment at least about 20%, and is in one embodiment 100%; (B) a partially fluorinated or fully fluorinated (perfluorinated) arylene group, including substituted and unsubstituted arylene groups, wherein hetero atoms, such as oxygen, nitrogen, sulfur, silicon, phosphorus, boron, or the like either may or may not be present in the arylene group, in one embodiment with at least about 5 carbon atoms, and in another embodiment with at least about 6 carbon atoms, and in one embodiment with no more than about 36 carbon atoms, in another embodiment with no more than about 28 carbon atoms, and in yet another embodiment with no more than about 24 carbon atoms, although the number of carbon atoms can be outside of these ranges, such as phenyl or the like, and wherein the degree of fluorination is in one embodiment at least about 5%, in another embodiment at least about 10%, and in yet another embodiment at least about 20%, and is in one embodiment 100%; (C) a partially fluorinated or fully fluorinated (perfluorinated) arylalkylene group, including substituted and unsubstituted arylalkylene groups, wherein the alkyl portion of the arylalkylene can be linear, branched, saturated, unsaturated, and/or cyclic, and wherein hetero atoms, such as oxygen, nitrogen, sulfur, silicon, phosphorus, boron, or the like either may or may not be present in either or both of the alkyl portion and the aryl portion of the arylalkylene group, in one embodiment with at least about 6 carbon atoms, and in another embodiment with at least about 7 carbon atoms, and in one embodiment with no more than about 36 carbon atoms, in another embodiment with no more than about 28 carbon atoms, and in yet another embodiment with no more than about 24 carbon atoms, although the number of carbon atoms can be outside of these ranges, such as benzyl or the like, and wherein the degree of fluorination is in one embodiment at least about 5%, in another embodiment at least about 10%, and in yet another embodiment at least about 20%, and is in one embodiment 100%; or (D) a partially fluorinated or fully fluorinated (perfluorinated) alkylarylene group, including substituted and unsubstituted alkylarylene groups, wherein the alkyl portion of the alkylarylene can be linear, branched, saturated, unsaturated, and/or cyclic, and wherein hetero atoms, such as oxygen, nitrogen, sulfur, silicon, phosphorus, boron, or the like either may or may not be present in either or both of the alkyl portion and the aryl portion of the alkylarylene group, in one embodiment with at least about 6 carbon atoms, and in another embodiment with at least about 7 carbon atoms, and in one embodiment with no more than about 36 carbon atoms, in another embodiment with no more than about 28 carbon atoms, and in yet another embodiment with no more than about 24 carbon atoms, although the number of carbon atoms can be outside of these ranges, such as tolyl or the like, and wherein the degree of fluorination is in one embodiment at least about 5%, in another embodiment at least about 10%, and in yet another embodiment at least about 20%, and is in one embodiment 100%;

$R_5$ is: (A) a partially fluorinated or fully fluorinated (perfluorinated) alkylene group, including linear, branched, saturated, unsaturated, cyclic, substituted, and unsubstituted alkylene groups, and wherein hetero atoms, such as oxygen, nitrogen, sulfur, silicon, phosphorus, boron, or the like either may or may not be present in the alkylene group, in one embodiment with at least about 1 carbon atom, and in one embodiment with no more than about 18 carbon atoms, in another embodiment with no more than about 12 carbon atoms, and in yet another embodiment with no more than about 6 carbon atoms, although the number of carbon atoms can be outside of these ranges, and wherein the degree of fluorination is in one embodiment at least about 5%, in another embodiment at least about 10%, and in yet another embodiment at least about 20%, and is in one embodiment 100%; (B) a partially fluorinated or fully fluorinated (perfluorinated) arylene group, including substituted and unsubstituted arylene groups, and wherein hetero atoms, such as oxygen, nitrogen, sulfur, silicon, phosphorus, boron, or the like either may or may not be present in the arylene group, in one embodiment with at least about 5 carbon atoms, and in another embodiment with at least about 6 carbon atoms, and in one embodiment with no more than about 36 carbon atoms, in another embodiment with no more than about 28 carbon atoms, and in yet another embodiment with no more than about 24 carbon atoms, although the number of carbon atoms can be outside of these ranges, such as phenyl or the like, and wherein the degree of fluorination is in one embodiment at least about 5%, in another embodiment at least about 10%, and in yet another embodiment at least about 20%, and is in one embodiment 100%; (C) a partially fluorinated or fully fluorinated (perfluorinated) arylalkylene group, including substituted and unsubstituted arylalkylene groups, wherein the alkyl portion of the arylalkylene can be linear, branched, saturated, unsaturated, and/or cyclic, and wherein hetero atoms, such as oxygen, nitrogen, sulfur, silicon, phosphorus, boron, or the like either may or may not be present in either or both of the alkyl portion and the aryl portion of the arylalkylene group, in one embodiment with at least about 6 carbon atoms, and in another embodiment with at least about 7 carbon atoms, and in one embodiment with no more than about 36 carbon atoms, in another embodiment with no more than about 28 carbon atoms, and in yet another embodiment with no more than about 24 carbon atoms, although the number of carbon atoms can be outside of these ranges, such as benzyl or the like, and wherein the degree of fluorination is in one embodiment at least about 5%, in another embodiment at least about 10%, and in yet another embodiment at least about 20%, and is in one embodiment 100%; or (D) a partially fluorinated or fully fluorinated (perfluorinated) alkylarylene group, including substituted and unsubstituted alkylarylene groups, wherein the alkyl portion of the alkylarylene can be linear, branched, saturated, unsaturated, and/or cyclic, and wherein hetero atoms, such as oxygen, nitrogen, sulfur, silicon, phosphorus, boron, or the like either may or may not be present in either or both of the alkyl portion and the aryl portion of the alkylarylene group, in one embodiment with at least about 6 carbon atoms, and in another embodiment with at least about 7 carbon atoms, and in one embodiment with no more than about 36 carbon atoms, in another embodiment with no more than about 28 carbon atoms, and in yet another embodiment with no more than about 24 carbon atoms, although the number of carbon atoms can be outside of these ranges, such as tolyl or the like, and wherein the degree of fluorination is in one embodiment at least about 5%, in another embodiment at least about 10%, and in yet another embodiment at least about 20%, and is in one embodiment 100%;

m is an integer representing the number of repeat —$OR_4$— groups, and can be in one embodiment at least 1, in another embodiment at least about 2, and in yet another embodiment at least about 5, and in one embodiment no more than about 10,000, in another embodiment no more than about 8,000, and in yet another embodiment no more than about 5,000, although the value can be outside of these ranges;

n is an integer representing the number of repeat —$OR_5$— groups, and can be in one embodiment 0, in another embodiment at least 1, in yet another embodiment at least about 2, and in still another embodiment at least about 5, and in one embodiment no more than about 10,000, in another embodiment no more than about 8,000, and in yet another embodiment no more than about 5,000, although the value can be outside of these ranges;

(v) x is an integer representing the number of repeat polyimide units, and is in one embodiment at least about 5, in another embodiment at least about 10, and in yet another embodiment at least about 20, and in one embodiment no more than about 20,000, in another embodiment no more than about 10,000, and in yet another embodiment no more than about 5,000, although the value can be outside of these ranges; and (vi) y is an integer representing the number of repeat fluorinated ether units, and is in one embodiment at least about 1, in another embodiment at least about 2, and in yet another embodiment at least about 5, and in one embodiment no more than about 10,000, in another embodiment no more than about 8,000, and in yet another embodiment no more than about 5,000, although the value can be outside of these ranges;

wherein examples of the substituents on the substituted alkylene, arylene, arylalkylene, and alkylarylene groups can be hydroxy groups, halogen atoms, amine groups, imine groups, ammonium groups, cyano groups, pyridine groups, pyridinium groups, ether groups, aldehyde groups, ketone groups, ester groups, amide groups, carbonyl groups, thiocarbonyl groups, sulfate groups, sulfonate groups, sulfonic acid groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, azo groups, cyanato groups, isocyanato groups, thiocyanato groups, isothiocyanato groups, carboxylate groups, carboxylic acid groups, urethane groups, urea groups, silyl groups, siloxyl groups, silane groups, mixtures thereof, or the like, wherein two or more substituents can be joined together to form a ring.

In one specific embodiment,

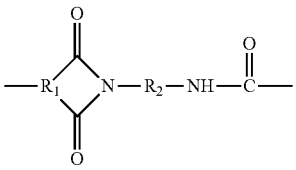

is

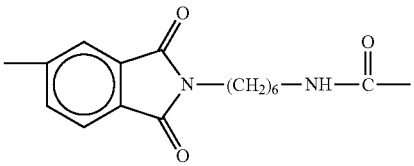

and

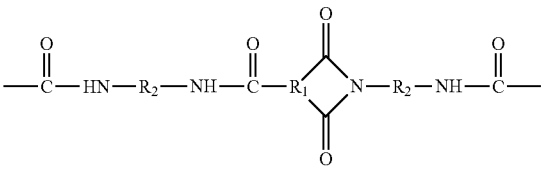

is

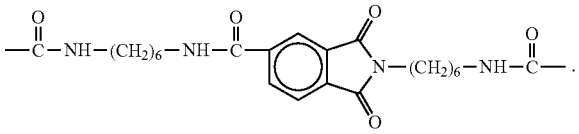

In another specific embodiment,

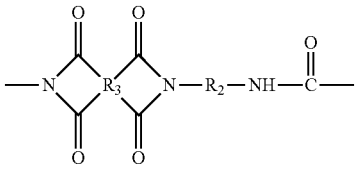

is

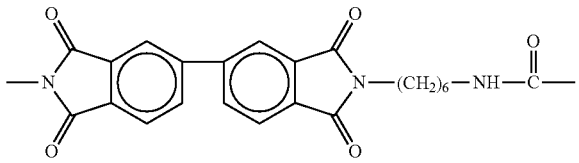

and

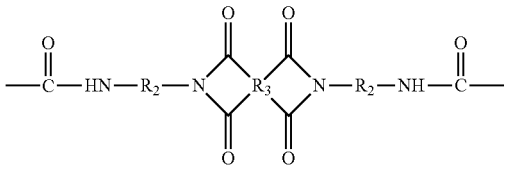

is

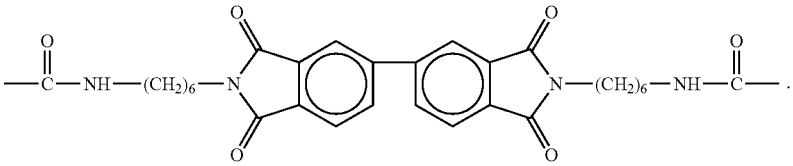

In another specific embodiment,

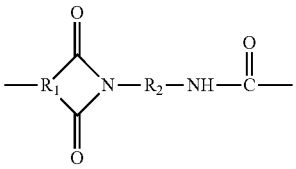

is

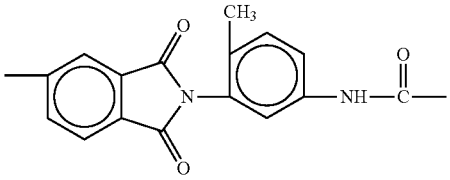

and

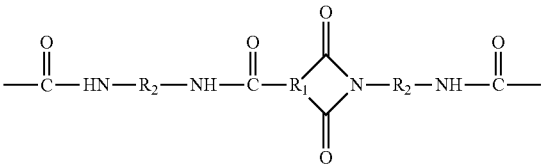

is

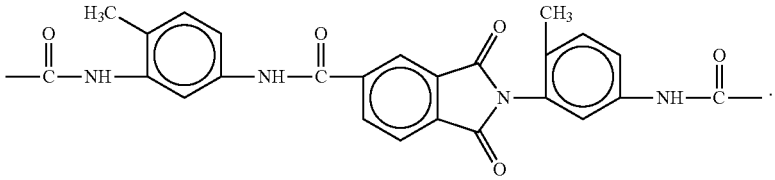

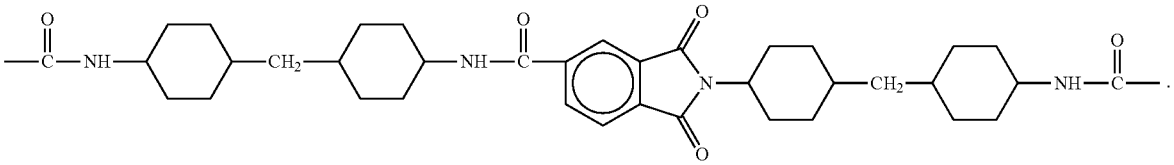

In another specific embodiment,

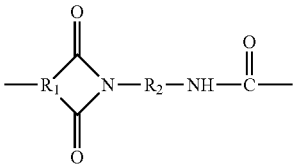

is

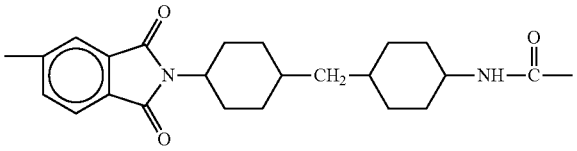

and

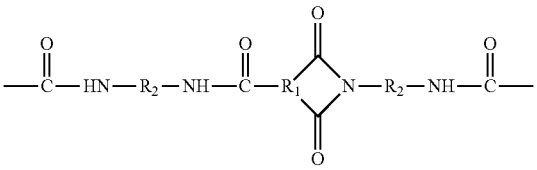

is

In one specific embodiment, the fluorinated poly(amide-imide) copolymer has at least one carboxylic acid functional group thereon. In another specific embodiment, the fluorinated poly(amide-imide) copolymer has at least one carboxylic acid functional group as a terminal end group.

In one specific embodiment, $R_4$ is $CF_2CF_2$ and $R_5$ is $CF_2$ such that $$-[[O-R_4]_m[O-R_5]_n]_y-$$

is $-(CF_2CF_2O)_r-(CF_2O)_q-$, r is an integer representing the number of repeat $(CF_2CF_2O)$ units, q is an integer representing the number of repeat $(CF_2O)$ units, r/q is in one embodiment at least about 0.9, and in another embodiment at least about 1.5, and in one embodiment no more than about 5, and in another embodiment no more than about 3, and Mn of $$-[[O-R_4]_m[O-R_5]_n]_y-$$

is in one embodiment at least about 900, and in one embodiment no more than about 3,500. In another specific embodiment, r has an average value of about 4.4 and q has an average value of about 1.7, r/q is about 2.5, and Mn is about 2,000. In yet another embodiment, the fluorinated polyether portion is a poly(trifluoropropylene ether) (in a specific embodiment with an average Mw about 400).

Suitable fluorinated polyether precursors include FLUOROLINK® C, available from Solvay Solexis Inc., West Deptford, N.J., and like commercially available products. The synthesis of copolymers by amide-imide synthetic processes is known in the art and described in, for example, U.S. Patent Publication 2009/0234060, the disclosure of which is totally incorporated herein by reference. Methods of preparing fluorinated ethers are also known, and are described in, for example, U.S. Pat. Nos. 5,446,205 and 7,329,784 and U.S. Patent Publication 2004/0024153, the disclosures of each of which are totally incorporated herein by reference.

The copolymers have weight average molecular weights of in one embodiment at least about 2,000, in another embodiment at least about 4,000, and in yet another embodiment at least about 5,000, and in one embodiment no more than about 2,000,000, in another embodiment no more than about 1,000,000, and in yet another embodiment no more than about 500,000, although Mw can be outside of these ranges.

The copolymers have number average molecular weights of in one embodiment at least about 2,000, in another embodiment at least about 4,000, and in yet another embodiment at least about 5,000, and in one embodiment no more than about 1,000,000, in another embodiment no more than about 800,000, and in yet another embodiment no more than about 500,000, although Mn can be outside of these ranges.

The copolymers exhibit glass transition temperatures of in one embodiment at least about 80° C., in another embodiment at least about 100° C., and in yet another embodiment at least about 120° C., and in one embodiment no more than about 450° C., in another embodiment no more than about 400° C., and in yet another embodiment no more than about 350° C., although the temperature can be outside of these ranges.

The copolymer (or the precursor monomers) is present in the solids content of the wet coating composition in any desired or effective amount, in one embodiment at least about 80 percent by weight of the solids content of the wet coating composition, in another embodiment, at least about 90 percent by weight of the solids content of the wet coating composition, in yet another embodiment at least about 99 percent by weight of the solids content of the wet coating composition, and in still another embodiment 100 percent by weight of the solids content of the wet coating composition, although the amount can be outside of these ranges.

The copolymer is present in the dried coating (or the solids content of the wet coating composition) in any desired or effective amount, in one embodiment at least about 80 percent by weight of the dried composition, in another embodiment, at least about 90 percent by weight of the dried coating composition, in yet another embodiment at least about 99 percent by weight of the dried coating composition, and in still another embodiment 100 percent by weight of the dried coating composition, although the amount can be outside of these ranges.

The coatings disclosed herein can be employed as a printhead front face coating for an inkjet printhead configured to eject any suitable ink, including aqueous inks, solvent inks, UV-curable inks, dye sublimation inks, solid phase change inks, or the like. An exemplary ink jet printhead suitable for use with the oleophobic low adhesion coating disclosed herein is described in FIG. 1.

Referring to FIG. 1, an ink jet printhead 20 according to one embodiment includes a support brace 22, a nozzle plate 24 bonded to the support brace 22, and an oleophobic low adhesion coating, such as oleophobic low adhesion coating 26.

The support brace 22 is formed of any suitable material, such as stainless steel or the like, and include apertures 22*a* defined therein. The apertures 22*a* communicate with an ink source (not shown). The nozzle plate 24 is formed of any suitable material, such as polyimide or the like, and includes nozzles 24*a* defined therein. The nozzles 24*a* communicate with the ink source via the apertures 22*a* such that ink from the ink source is jettable from the printhead 20 onto a recording substrate through a nozzle 24*a*.

In the illustrated embodiment, the nozzle plate 24 is bonded to the support brace by an intervening adhesive material 28. The adhesive material 28 can be provided as a thermoplastic adhesive that can be melted during a bonding process to bond the nozzle plate 24 to the support brace 22. The nozzle plate 24 and the oleophobic low adhesion coating 26 can also be heated during the bonding process. Depending on the material from which the thermoplastic adhesive is formed, the bonding temperature can be in a range of from about 180° C. to about 325° C., although the temperature can be outside of these ranges.

Conventional oleophobic low adhesion coatings tend to degrade when exposed to temperatures encountered during typical bonding processes or other high-temperature, high-pressure processes encountered during fabrication of ink jet printheads. The oleophobic low adhesion coating 26 disclosed herein, however, exhibits a sufficiently low adhesion (indicated by low sliding angles) and high contact angle with respect to an ink after it has been heated to the bonding temperature that it can provide a self-cleaning, contamination-free ink jet printhead 20 with high drool pressure. The ability of the oleophobic low adhesion coating 26 to resist substantial degradation in desirable surface properties, including low sliding angle and high contact angle, upon exposure to elevated temperatures, enables ink jet printheads having self-cleaning abilities while maintaining high drool pressure to be fabricated using high-temperature and high-pressure processes. An exemplary process of forming an ink jet printhead is described with respect to FIGS. 1 to 4.

Figure 2:
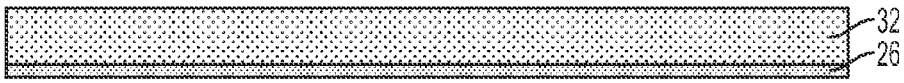
FIGS. 2 to 4 illustrate a process of forming the ink jet printhead shown in FIG. 2 according to one embodiment.

Referring to FIG. 2, an ink jet printhead, such as printhead 20, can be formed by forming an oleophobic low adhesion coating such coating 26 on a substrate 32. The substrate 32 can be formed of any suitable material, such as polyimide or the like.

In one embodiment, the oleophobic low adhesion coating 26 may be formed on the substrate 32 by initially applying the reactant mixture that includes, for example, the mixture of monomers, including a fluorinated polyether such as FLUO- ROLINK® C, an anhydride, such as trimellitic anhydride, 4,4'-oxydiphthalic anhydride, 3,3',4,4'-benzophenonetetracarboxylic dianhydride, or the like, as well as mixtures thereof, an isocyanate, such as methylene diisocyanate, toluene diisocyanate, hexamethylene diisocyanate, isophorone diisocyanate, or the like, as well as mixtures thereof, and a suitable solvent, such as N-methyl pyrrolidinone, N,N-dimethylformamide, tetrahydrofuran, or the like, as well as mixtures thereof. After the reactant mixture is applied to the substrate 32, the reactants are reacted together to form the oleophobic low adhesion coating 26. The reactants can be reacted together by, for example, curing the reactant mixture. The reactant mixture is first cured at a temperature of in one embodiment at least about 25° C., in another embodiment at least about 35° C., and in yet another embodiment at least about 50° C., and in one embodiment no more than about 400° C., in another embodiment no more than about 350° C., and in yet another embodiment no more than about 300° C., although the temperature can be outside of these ranges, for a period of in one embodiment at least about 5 minutes, in another embodiment at least about 10 minutes, and yet another embodiment at least about 25 minutes, and in one embodiment no more than about 6 hours, in another embodiment no more than about 5 hours, and in yet another embodiment no more than about 4 hours, although the period of time can be outside of these ranges, followed by a high temperature post-cure at in one embodiment in one embodiment at least about 120° C., in another embodiment at least about 140° C., and in yet another embodiment at least about 160° C., and in one embodiment no more than about 450° C., in another embodiment no more than about 400° C., and in yet another embodiment no more than about 350° C., although the temperature can be outside of these ranges, for a period of in one embodiment at least about 5 minutes, in another embodiment at least about 10 minutes, and yet another embodiment at least about 15 minutes, and in one embodiment no more than about 6 hours, in another embodiment no more than about 5 hours, and in yet another embodiment no more than about 4 hours, although the period of time can be outside of these ranges.

The reactant mixture can be applied to the substrate 32 using any suitable method, such as die extrusion coating, dip coating, spray coating, spin coating, flow coating, stamp printing, blade techniques, or the like. An air atomization device such as an air brush or an automated air/liquid spray can be used to spray the reactant mixture. The air atomization device can be mounted on an automated reciprocator that moves in a uniform pattern to cover the surface of the substrate 32 with a uniform (or substantially uniform) amount of the reactant mixture. The use of a doctor blade is another technique that can be employed to apply the reactant mixture. In flow coating, a programmable dispenser is used to apply the reactant mixture.

In yet another embodiment, oleophobic low adhesion coating 26 can be first cured into a sheet and then applied and bonded to substrate 32 with any desirable or suitable adhesive material. Further details on this method are disclosed in, for example, U.S. Patent Publications 2011/0157278 and 2011/0228005, the disclosures of each of which are totally incorporated herein by reference.

Figure 3:
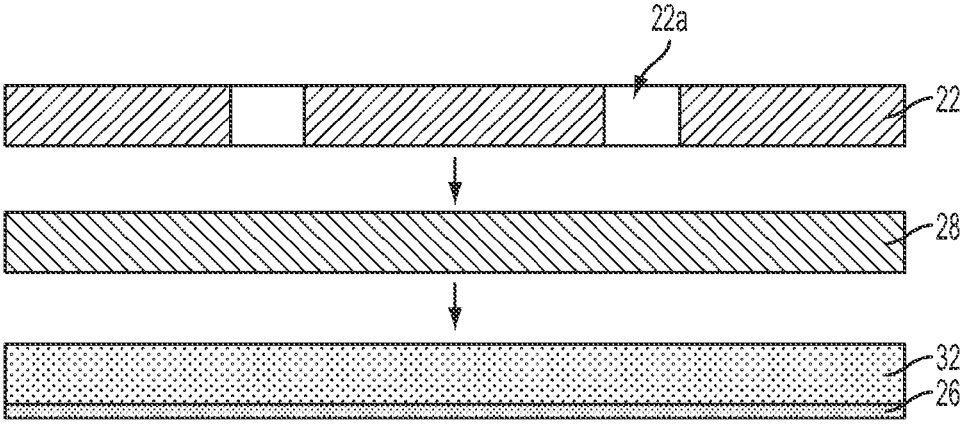
Figure 4:
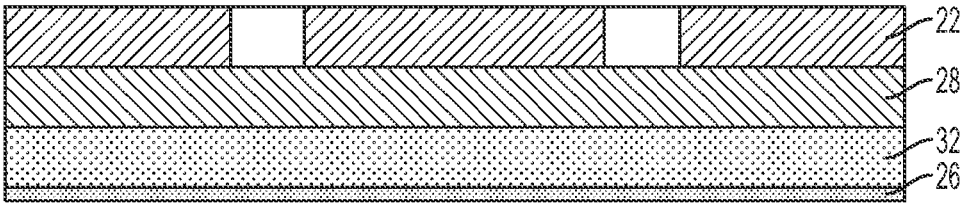

Referring to FIG. 3, the substrate 32 is bonded to the aperture brace 22 via adhesive material 28, resulting in the structure shown in FIG. 5. In one embodiment, the adhesive material 28 is bonded to the aperture brace 22 before being bonded to the substrate 32. In another embodiment, the adhesive material 28 is bonded to the substrate 32 before being bonded to the aperture brace 22. In yet another embodiment, the adhesive material 28 is bonded to the substrate 32 and the aperture brace 22 simultaneously.

In embodiments where the adhesive material 28 is provided as a thermoplastic adhesive, the adhesive material 28 is bonded to the substrate 32 and the aperture brace 22 by melting the thermoplastic adhesive at, and subjecting the oleophobic low adhesion coating 26 to, a bonding temperature and a bonding pressure. The bonding temperature is in one embodiment at least about 180° C., and in one embodiment no more than about 325° C., and in another embodiment no more than about 290° C., although the temperatures can be outside of these ranges. The bonding pressure is in one embodiment at least about 100 psi, and in one embodiment no more than about 400 psi, and in another embodiment no more than about 300 psi, although the pressures can be outside of these ranges.

After bonding the substrate 32 to the aperture brace 22, the aperture brace 22 can be used as a mask during one or more patterning processes to extend the apertures 22*a* into the adhesive material 28, as shown in FIG. 1. The aperture brace 22 can also be used as a mask during one or more patterning processes to form nozzles 24*a* in the substrate 32, thereby forming the nozzle plate 24 shown in FIG. 1. The one or more patterning processes used to form nozzles 24*a* can also be applied to form nozzle openings 26*a* within the oleophobic low adhesion coating 26, wherein the nozzle openings 26*a* communicate with the nozzles 24*a*. In one embodiment, the apertures 22*a* can be extended into the adhesive material 28 by a laser ablation patterning process or the like. In one embodiment, the nozzles 24*a* and nozzle openings 26*a* can be formed in the substrate 32 and the oleophobic low adhesion coating 26, respectively, by a laser ablation patterning process or the like.

The front face coatings disclosed herein are thermally stable under printhead fabrication conditions and printer operating conditions. The front face coatings exhibit oleophobic characteristics after being subjected to temperatures of in one embodiment at least about 180° C., and in one embodiment no more than about 325° C., and in another embodiment no more than about 290° C., although the temperatures can be outside of these ranges, and pressures of in one embodiment at least about 100 psi, and in one embodiment no more than about 400 psi, and in another embodiment no more than about 300 psi, although the pressures can be outside of these ranges, for periods of time of in one embodiment at least about 10 minutes, and in another embodiment at least about 30 minutes, and in one embodiment no longer than about 2 hours, although the period of time can be outside of these ranges. The surface coating can be bonded to a stainless steel aperture brace at high temperature and high pressure without any degradation, and the resulting printhead can prevent ink contamination because ink droplets can roll off the printhead front face, leaving behind no residue.

The oleophobic low adhesion surface coating includes an oleophobic low adhesion polymeric material configured such that jetted drops of ultra-violet gel ink or jetted drops of solid ink exhibit a contact angle of in one embodiment at least about 45°, in another embodiment at least about 55°, and in yet another embodiment at least about 65°, and in one embodiment no more than about 150°, although the contact angle can be outside of these ranges.

When ink is filled into the printhead, it is desired to maintain the ink within the nozzle until it is time to eject the ink. Generally, the greater the ink contact angle the better (higher) the drool pressure. Drool pressure relates to the ability of the aperture plate to avoid ink weeping out of the nozzle opening when the pressure of the ink tank (reservoir) increases. In some embodiments, the oleophobic low adhesion surface coatings described herein provide, in combination, low adhesion and high contact angle for ultra-violet curable gel ink and solid ink, which further provides the benefit of improved drool pressure or reduced or eliminated weeping of ink out of the nozzle.

The coatings disclosed herein have a surface energy of in one embodiment no more than about 80 dynes per centimeter, in another embodiment no more than about 75 dynes per centimeter, and in yet another embodiment no more than about 50 dynes per centimeter, although the surface energy can be outside of these ranges.

The coatings disclosed herein exhibit water contact angles of in one embodiment at least about 80°, in another embodiment at least about 90°, and in yet another embodiment at least 100°, although the value can be outside of these ranges.

Specific embodiments will now be described in detail. These examples are intended to be illustrative, and the claims are not limited to the materials, conditions, or process parameters set forth in these embodiments. All parts and percentages are by weight unless otherwise indicated.

EXAMPLE I

Trimellitic anhydride (18.82 g) and FLUOROLINK® C (6.4 g; obtained from Solvay Solexis Inc.) were dissolved in 200 mL N-methylpyrrolidinone solvent. With mechanical stirring and under flowing nitrogen gas, hexamethylene diisocyanate (25.0 g) was added. The mixture was then slowly heated to 80° C. over 2 h, and was maintained at this temperature for 1.5 h. Thereafter, the reaction solution was heated to 145° C. for 2 h. After subsequent cooling to room temperature, a viscous brownish solution was obtained.

r average value about 4.4, q average value about 1.7, r/q about 2.5

The solution thus obtained was applied on UPILEX polyimide film by a 0.25-mil Bird bar. The coating was dried first at 110° C. for 30 minutes, second at 160° C. for 45 minutes, and finally at 220° C. for 30 minutes. The cured film had a very smooth surface. The water contact angle of the cured film was 106.5°, the formamide contact angle was 93.4°, and the surface energy was 18.5 dyne/cm.

The obtained film had a glass transition temperature of about 155° C. as measured by DSC scanning, confirming the formation of a high performance polymer. Thermogravimetric analysis (TGA) to test the thermal stability of the polymer under air atmosphere showed less than 2.5% weight loss at 300° C., indicating high thermal stability, which was excellent for a printhead coating application.

It is believed that applying this film to a printhead nozzle plate as illustrated in FIGS. 1 to 4 as oleophobic low adhesion coating 26 will result in a printhead exhibiting, in some embodiments, advantages such as reduced or eliminates wetting, drooling, flooding, or contamination of ink over the printhead front face, ink phobicity and robustness to withstand maintenance procedures such as wiping of the printhead front face, ease of cleaning or, in some instances, self-cleaning properties, thereby reducing or eliminating hardware complexity, such as the need for a maintenance unit, reducing run cost and improving system reliability, sufficient robustness to survive both the temperature and pressure conditions encountered during printhead fabrication and the temperature conditions encountered during printer operation without degradation, improved anti-scratch properties, and improved chemical resistance to varied chemical environments.

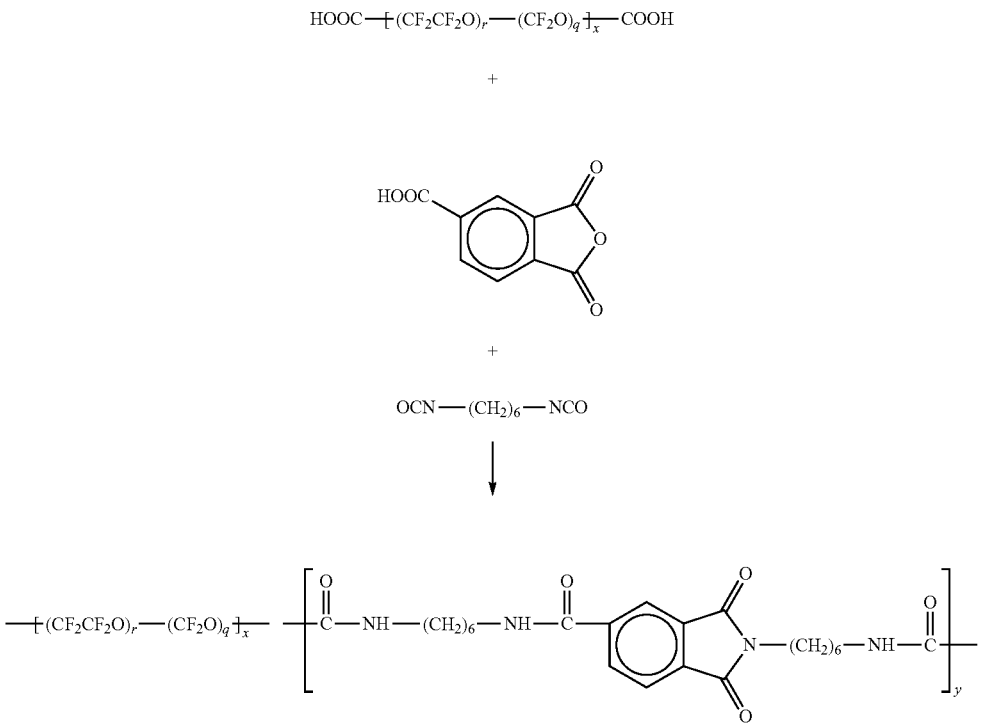

EXAMPLE II

The process of Example I is repeated except that the trimellitic anhydride is replaced with an equimolar amount of 3,3',4,4'-biphenyltetracarboxylic acid dianhydride [BPDA]. It is believed that similar results will be obtained.

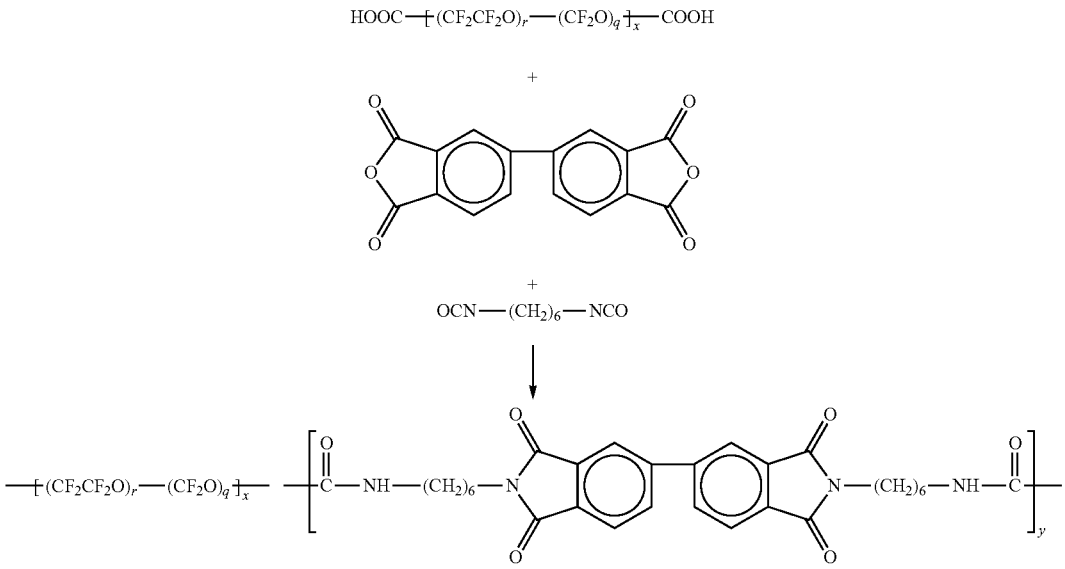

EXAMPLE III

The process of Example I is repeated except that the hexamethylene diisocyanate is replaced with an equimolar amount of toluene diisocyanate. It is believed that similar results will be obtained.

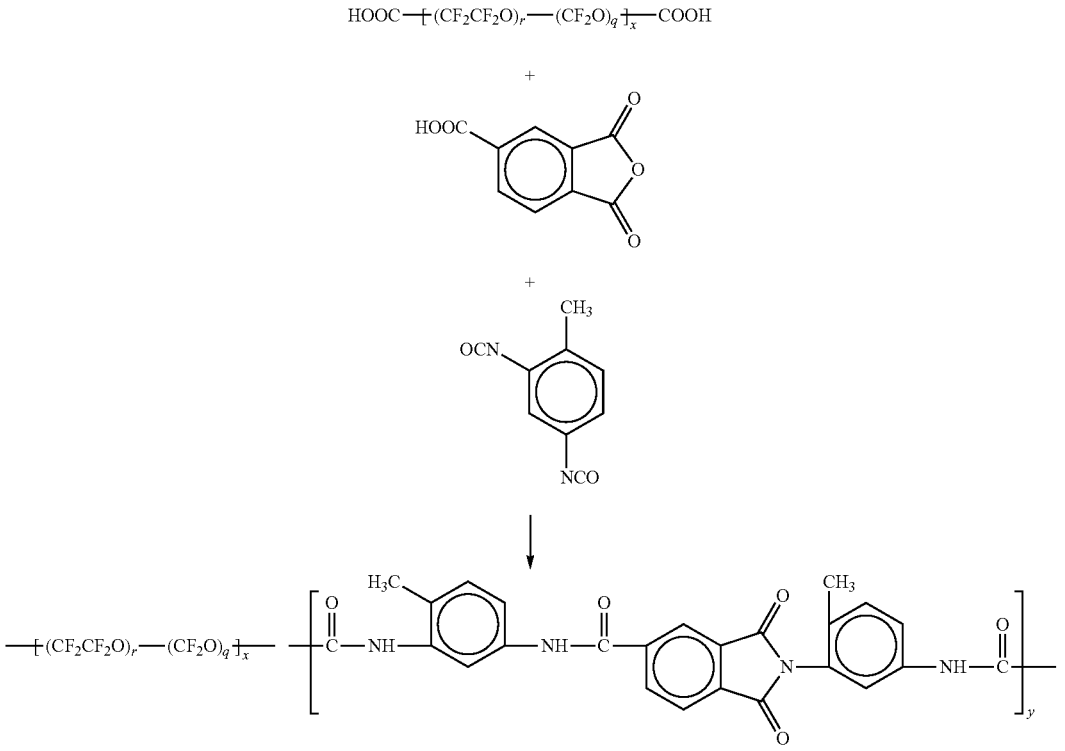

EXAMPLE IV

The process of Example I is repeated except that half of the hexamethylene diisocyanate is replaced with an equimolar amount of methylene bis-(4-cyclohexylisocyanate). It is believed that similar results will be obtained.

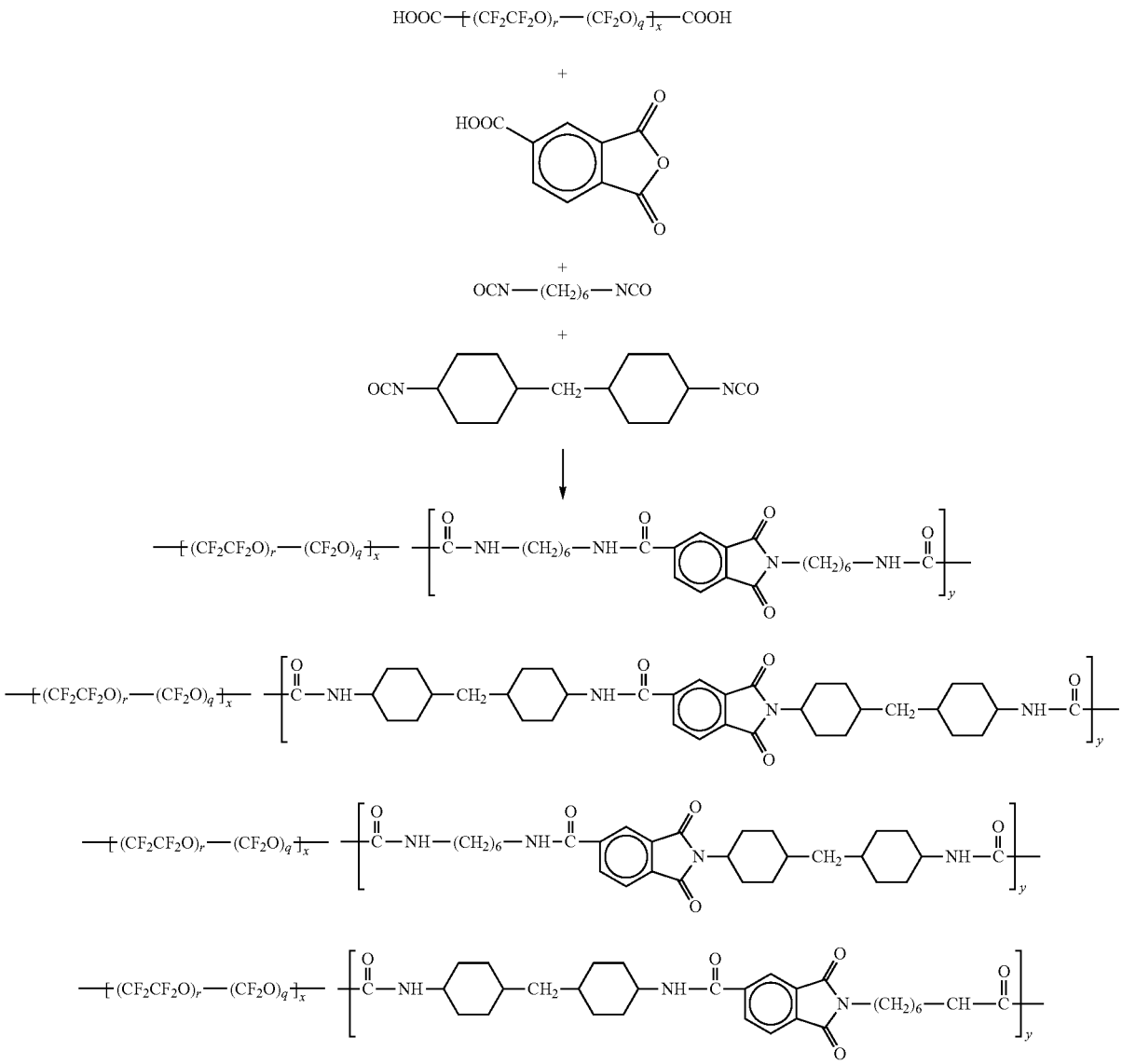

EXAMPLE V

The process of Example I is repeated except that the FLUOROLINK® C is replaced with an equimolar amount of poly(trifluoropropylene ether) dipropionic acid (average Mw 400). It is believed that similar results will be obtained.

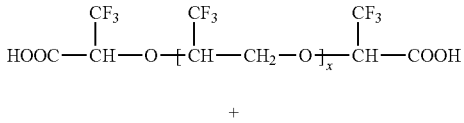

-continued

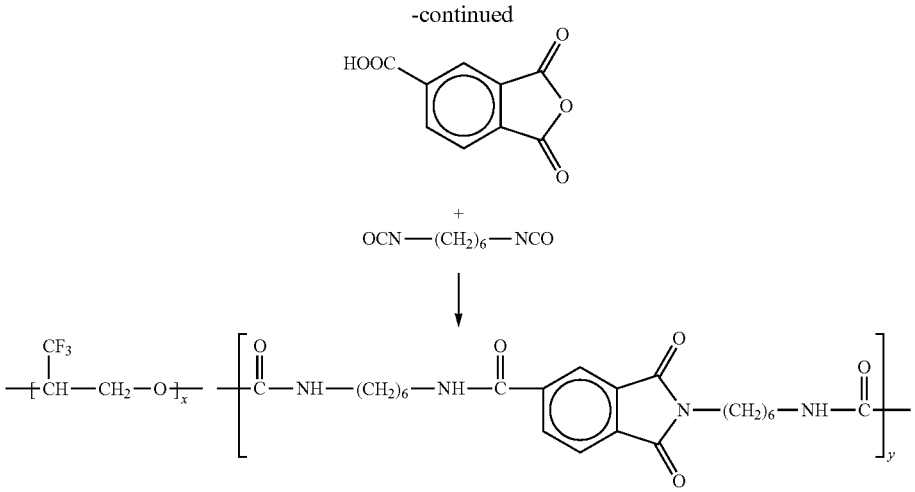

Other embodiments and modifications of the present invention may occur to those of ordinary skill in the art subsequent to a review of the information presented herein; these embodiments and modifications, as well as equivalents thereof, are also included within the scope of this invention.

The recited order of processing elements or sequences, or the use of numbers, letters, or other designations therefor, is not intended to limit a claimed process to any order except as specified in the claim itself.

What is claimed is:

1. An ink jet printhead comprising a plurality of channels, wherein the channels are capable of being filled with ink from an ink supply and wherein the channels terminate in nozzles on one surface of the printhead, the surface being coated with a coating composition comprising a fluorinated poly(amide-imide) copolymer, wherein the fluorinated poly(amide-imide) copolymer is a poly(amide-imide)/fluorinated polyether copolymer of the formula

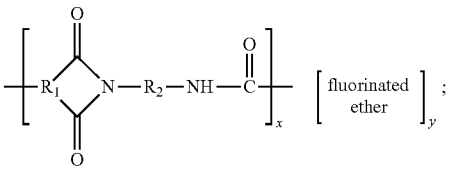

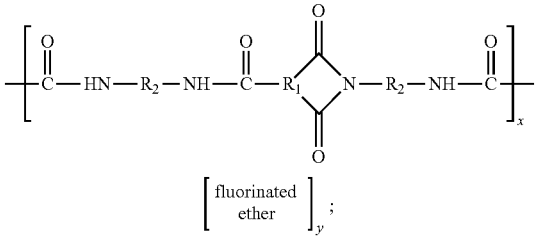

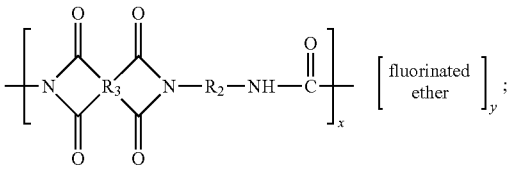

-continued

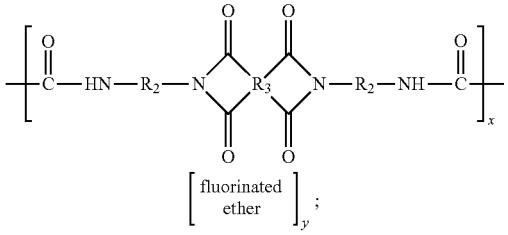

or mixtures thereof; wherein:

(i) $R_1$ is:

(A) an arylene group, including substituted and unsubstituted arylene groups, wherein hetero atoms either may or may not be present in the arylene group;

(B) an arylalkylene group, including substituted and unsubstituted arylalkylene groups, wherein hetero atoms either may or may not be present in either or both of the alkyl portion and the aryl portion of the arylalkylene group; or (C) an alkylarylene group, including substituted and unsubstituted alkylarylene groups, wherein hetero atoms either may or may not be present in either or both of the alkyl portion and the aryl portion of the alkylarylene group;

(ii) $R_2$ is:

(A) an alkylene group, including substituted and unsubstituted alkylene groups, wherein hetero atoms either may or may not be present in the alkylene group;

(B) an arylene group, including substituted and unsubstituted arylene groups, wherein hetero atoms either may or may not be present in the arylene group;

(C) an arylalkylene group, including substituted and unsubstituted arylalkylene groups, wherein hetero atoms either may or may not be present in either or both of the alkyl portion and the aryl portion of the arylalkylene group; or (D) an alkylarylene group, including substituted and unsubstituted alkylarylene groups, wherein hetero atoms either may or may not be present in either or both of the alkyl portion and the aryl portion of the alkylarylene group;

(iii) $R_3$ is:

(A) an arylene group, including substituted and unsubstituted arylene groups, wherein hetero atoms either may or may not be present in the arylene group;

(B) an arylalkylene group, including substituted and unsubstituted arylalkylene groups, wherein hetero atoms either may or may not be present in either or both of the alkyl portion and the aryl portion of the arylalkylene group; or (C) an alkylarylene group, including substituted and unsubstituted alkylarylene groups, wherein hetero atoms either may or may not be present in either or both of the alkyl portion and the aryl portion of the alkylarylene group;

(iv) "fluorinated ether" represents one or more partially fluorinated or fully fluorinated ether monomers;

(v) x is a positive integer representing the number of repeat poly(amide-imide) units; and (vi) y is a positive integer representing the number of repeat fluorinated ether units.

2. The printhead according to claim 1 wherein "fluorinated ether" has a degree of fluorination of at least about 5%.

3. The printhead according to claim 1 wherein $$\left[\begin{matrix}\text{fluorinated}\\ \text{ether}\end{matrix}\right]$$

is $—(CF_2CF_2O)_r—(CF_2O)_q—$, wherein r is an integer representing the number of repeat $(CF_2CF_2O)$ units, q is an integer representing the number of repeat $(CF_2O)$ units, and r/q is from about 0.9 to about 5, and wherein the poly(amide-imide)/fluorinated polyether copolymer has at least one carboxylic acid functional group thereon.

4. The printhead according to claim 1 wherein

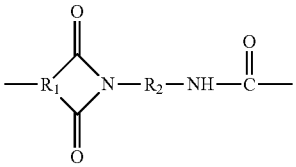

is

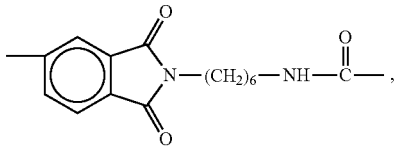

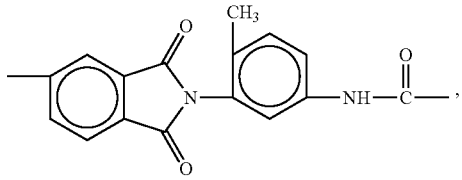

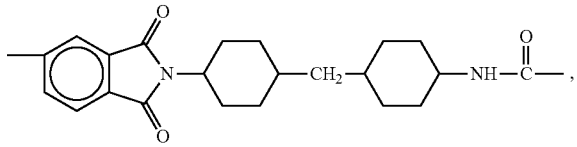

or mixtures thereof,

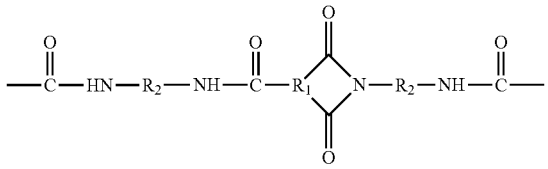

is

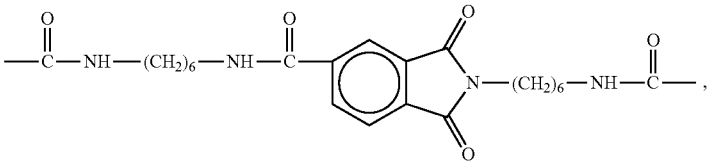

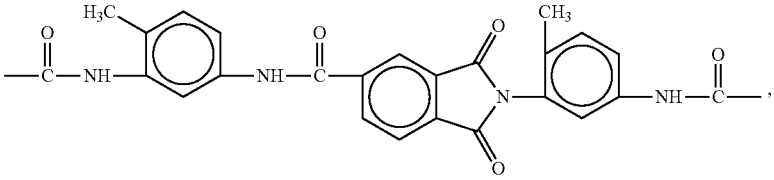

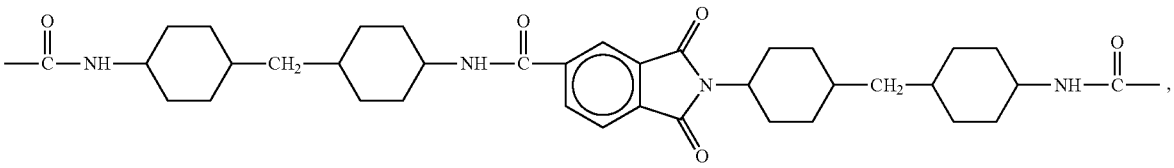

or mixtures thereof,

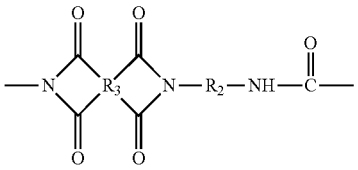

is

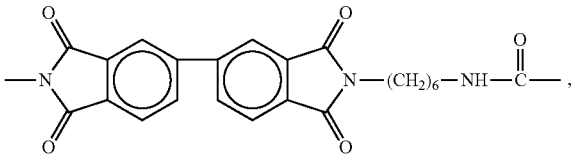

and

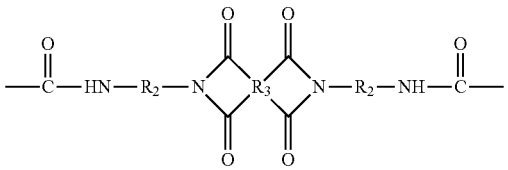

is

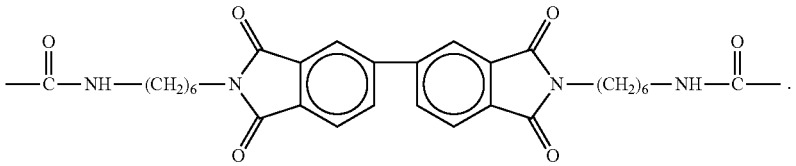

5. The printhead according to claim 1 wherein

[fluorinated ether]

is a poly(trifluoropropylene ether).

6. The printhead according to claim 1 wherein the fluorinated poly(amide-imide) copolymer has a weight average molecular weight of from about 2,000 to about 2,000,000.

7. The printhead according to claim 1 wherein the fluorinated poly(amide-imide) copolymer has a number average molecular weight of from about 2,000 to about 1,000,000.

8. The printhead according to claim 1 wherein the fluorinated poly(amide-imide) copolymer has a glass transition temperature of from about 80° C. to about 450° C.

9. The printhead according to claim 1 wherein the fluorinated poly(amide-imide) copolymer coating has a surface energy of no more than about 80 dynes per centimeter.

10. The printhead according to claim 1 wherein the fluorinated poly(amide-imide) copolymer coating has a surface energy of no more than about 50 dynes per centimeter.

11. The printhead according to claim 1 wherein the fluorinated poly(amide-imide) copolymer coating exhibits a water contact angle of at least about 80°.

12. The printhead according to claim 1 wherein the fluorinated poly(amide-imide) copolymer coating exhibits a water contact angle of at least about 100°.

13. An ink jet printhead comprising a plurality of channels, wherein the channels are capable of being filled with ink from an ink supply and wherein the channels terminate in nozzles on one surface of the printhead, the surface being coated with a coating composition comprising a polyimide/fluorinated polyether copolymer of the formula

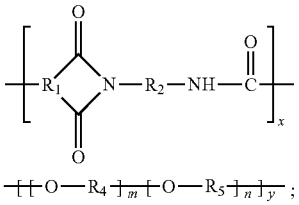

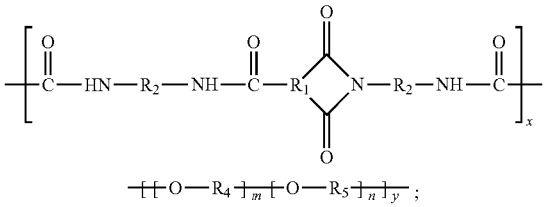

-continued

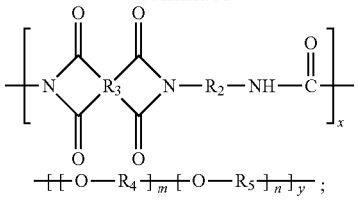

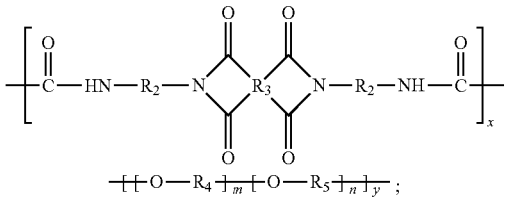

or mixtures thereof; wherein:

(i) $R_1$ is:

(A) an arylene group, including substituted and unsubstituted arylene groups, wherein hetero atoms either may or may not be present in the arylene group;

(B) an arylalkylene group, including substituted and unsubstituted arylalkylene groups, wherein hetero atoms either may or may not be present in either or both of the alkyl portion and the aryl portion of the arylalkylene group; or (C) an alkylarylene group, including substituted and unsubstituted alkylarylene groups, wherein hetero atoms either may or may not be present in either or both of the alkyl portion and the aryl portion of the alkylarylene group;

(ii) $R_2$ is:

(A) an alkylene group, including substituted and unsubstituted alkylene groups, wherein hetero atoms either may or may not be present in the alkylene group;

(B) an arylene group, including substituted and unsubstituted arylene groups, wherein hetero atoms either may or may not be present in the arylene group;

(C) an arylalkylene group, including substituted and unsubstituted arylalkylene groups, wherein hetero atoms either may or may not be present in either or both of the alkyl portion and the aryl portion of the arylalkylene group; or (D) an alkylarylene group, including substituted and unsubstituted alkylarylene groups, wherein hetero atoms either may or may not be present in either or both of the alkyl portion and the aryl portion of the alkylarylene group;

(iii) $R_3$ is:

(A) an arylene group, including substituted and unsubstituted arylene groups, wherein hetero atoms either may or may not be present in the arylene group;

(B) an arylalkylene group, including substituted and unsubstituted arylalkylene groups, wherein hetero atoms either may or may not be present in either or both of the alkyl portion and the aryl portion of the arylalkylene group; or (C) an alkylarylene group, including substituted and unsubstituted alkylarylene groups, wherein hetero atoms either may or may not be present in either or both of the alkyl portion and the aryl portion of the alkylarylene group;

(iv) "fluorinated ether" represents one or more partially fluorinated or fully fluorinated ether monomers;

(v) x is a positive integer representing the number of repeat polyimide units;

(vi) y is a positive integer representing the number of repeat fluorinated ether units;

(vii) $R_4$ is:

(A) a partially fluorinated or fully fluorinated alkylene group, including substituted and unsubstituted alkylene groups, wherein hetero atoms either may or may not be present in the alkylene group;

(B) a partially fluorinated or fully fluorinated arylene group, including substituted and unsubstituted arylene groups, wherein hetero atoms either may or may not be present in the arylene group;

(C) a partially fluorinated or fully fluorinated arylalkylene group, including substituted and unsubstituted arylalkylene groups, wherein hetero atoms either may or may not be present in either or both of the alkyl portion and the aryl portion of the arylalkylene group; or (D) a partially fluorinated or fully fluorinated alkylarylene group, including substituted and unsubstituted alkylarylene groups, wherein hetero atoms either may or may not be present in either or both of the alkyl portion and the aryl portion of the alkylarylene group;

wherein $R_4$ has a degree of fluorination of at least about 10%;

(viii) $R_5$ is:

(A) a partially fluorinated or fully fluorinated alkylene group, including substituted and unsubstituted alkylene groups, wherein hetero atoms either may or may not be present in the alkylene group;

(B) a partially fluorinated or fully fluorinated arylene group, including substituted and unsubstituted arylene groups, wherein hetero atoms either may or may not be present in the arylene group;

(C) a partially fluorinated or fully fluorinated arylalkylene group, including substituted and unsubstituted arylalkylene groups, wherein hetero atoms either may or may not be present in either or both of the alkyl portion and the aryl portion of the arylalkylene group; or (D) a partially fluorinated or fully fluorinated alkylarylene group, including substituted and unsubstituted alkylarylene groups, wherein hetero atoms either may or may not be present in either or both of the alkyl portion and the aryl portion of the alkylarylene group;

wherein $R_5$ has a degree of fluorination of at least about 10%;

(ix) m is an integer representing the number of repeat —$OR_4$— groups and is at least 1; and (x) n is an integer representing the number of repeat —$OR_5$— groups and may be 0;

(xi) wherein the polyimide/fluorinated polyether copolymer has a weight average molecular weight of from about 5,000 to about 500,000 and a number average molecular weight of from about 5,000 to about 500,000.

14. The printhead according to claim 13 wherein the polyimide/fluorinated polyether copolymer coating has a surface energy of no more than about 50 dynes per centimeter.

15. The printhead according to claim 13 wherein the polyimide/fluorinated polyether copolymer coating exhibits a water contact angle of at least about 100°.

16. The printhead according to claim 13 wherein

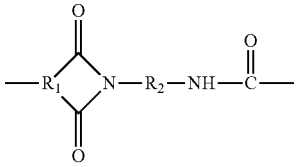

is

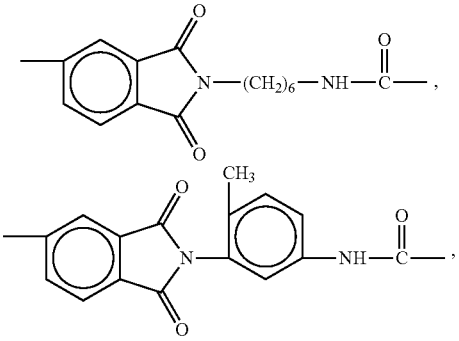

-continued
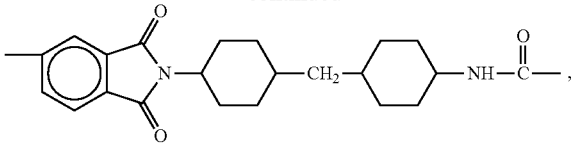
or mixtures thereof,
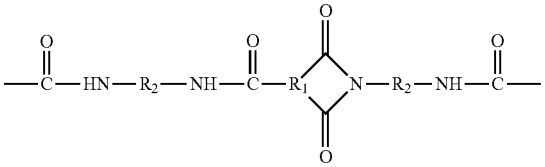
is
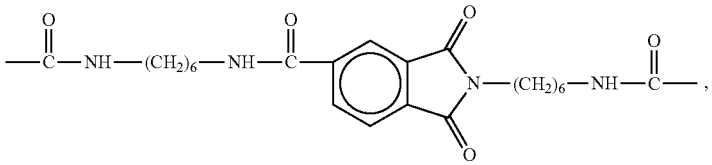
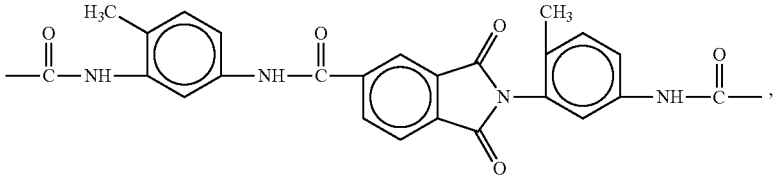
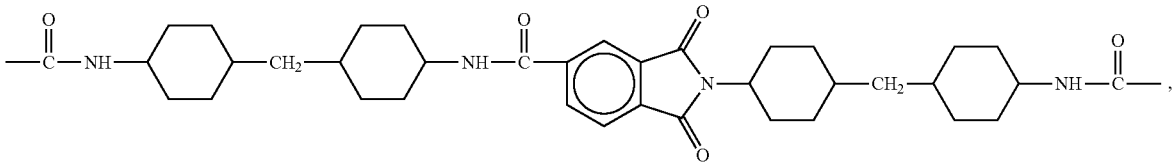
or mixtures thereof,
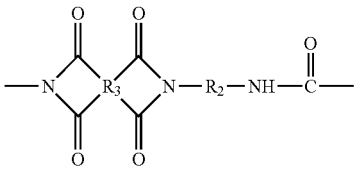
is
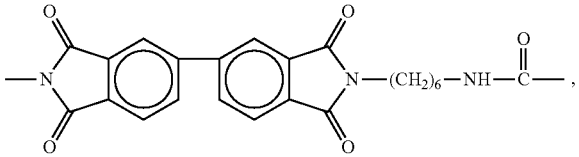
and
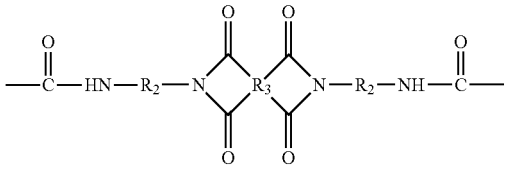
is
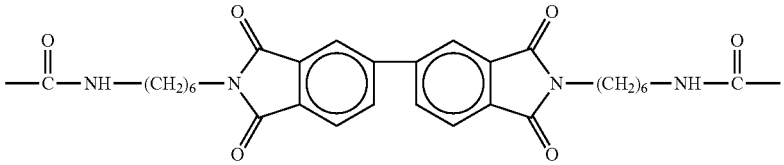

and

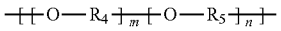

is —$(CF_2CF_2O)_r$—$(CF_2O)_q$—, wherein r is an integer representing the number of repeat $(CF_2CF_2O)$ units, q is an integer representing the number of repeat $(CF_2O)$ units, r/q is from about 0.9 to about 5, and Mn of

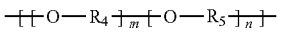

is from about 900 to about 3,500, and wherein the polyimide/fluorinated polyether copolymer has at least one carboxylic acid functional group as a terminal end group.

17. An ink jet printhead comprising a plurality of channels, wherein the channels are capable of being filled with ink from an ink supply and wherein the channels terminate in nozzles on one surface of the printhead, the surface being coated with a coating composition comprising a polyimide/fluorinated polyether copolymer of the formula

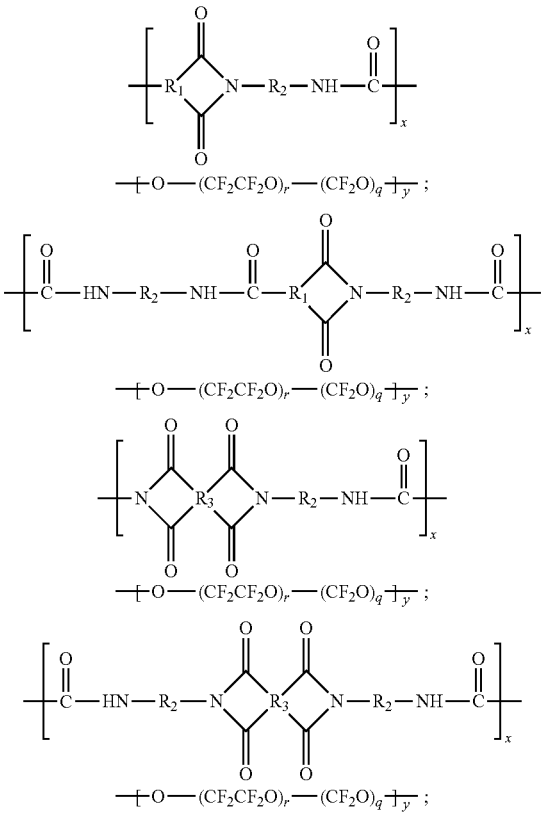

or mixtures thereof; wherein:

(i) $R_1$ is:

(A) an arylene group, including substituted and unsubstituted arylene groups, wherein hetero atoms either may or may not be present in the arylene group;

(B) an arylalkylene group, including substituted and unsubstituted arylalkylene groups, wherein hetero atoms either may or may not be present in either or both of the alkyl portion and the aryl portion of the arylalkylene group; or (C) an alkylarylene group, including substituted and unsubstituted alkylarylene groups, wherein hetero atoms either may or may not be present in either or both of the alkyl portion and the aryl portion of the alkylarylene group;

(ii) $R_2$ is:

(A) an alkylene group, including substituted and unsubstituted alkylene groups, wherein hetero atoms either may or may not be present in the alkylene group;

(B) an arylene group, including substituted and unsubstituted arylene groups, wherein hetero atoms either may or may not be present in the arylene group;

(C) an arylalkylene group, including substituted and unsubstituted arylalkylene groups, wherein hetero atoms either may or may not be present in either or both of the alkyl portion and the aryl portion of the arylalkylene group; or (D) an alkylarylene group, including substituted and unsubstituted alkylarylene groups, wherein hetero atoms either may or may not be present in either or both of the alkyl portion and the aryl portion of the alkylarylene group;

(iii) $R_3$ is:

(A) an arylene group, including substituted and unsubstituted arylene groups, wherein hetero atoms either may or may not be present in the arylene group;

(B) an arylalkylene group, including substituted and unsubstituted arylalkylene groups, wherein hetero atoms either may or may not be present in either or both of the alkyl portion and the aryl portion of the arylalkylene group; or (C) an alkylarylene group, including substituted and unsubstituted alkylarylene groups, wherein hetero atoms either may or may not be present in either or both of the alkyl portion and the aryl portion of the alkylarylene group;

(iv) r is an integer representing the number of repeat —$(CF_2CF_2O)$— units;

(v) q is an integer representing the number of repeat —$(CF_2O)$— units;

(vi) r/q is from about 1.5 to about 3;

(vii) x is a positive integer representing the number of repeat polyimide units; and (viii) y is a positive integer representing the number of repeat fluorinated ether units.

18. The printhead according to claim 17 wherein the polyimide/fluorinated polyether copolymer coating has a surface energy of no more than about 50 dynes per centimeter.

19. The printhead according to claim 17 wherein the polyimide/fluorinated polyether copolymer coating exhibits a water contact angle of at least about 100°.

* * * * *